United States Patent [19]

Pratt

[11] Patent Number: 4,965,013

[45] Date of Patent: Oct. 23, 1990

[54] METHOD OF HIGH TEMPERATURE LAUNDERING USING SODIUM CITRATE AND AN ANIONIC

[75] Inventor: Karen L. Pratt, Elkhart, Ind.

[73] Assignee: Miles Inc., Elkhart, Ind.

[21] Appl. No.: 345,972

[22] Filed: May 1, 1989

[51] Int. Cl.[5] ..... C11D 3/22; C11D 1/02; C11D 7/10; D06L 1/12

[52] U.S. Cl. ..... 252/174.19; 8/137; 252/173; 252/549; 252/550; 252/554; 252/558; 252/DIG. 6; 252/DIG. 11; 252/DIG. 14

[58] Field of Search ..... 252/174.19, DIG. 5, 252/DIG. 11

[56] References Cited

U.S. PATENT DOCUMENTS

| | | | |
|---|---|---|---|
| 4,028,262 | 6/1977 | Cheng | 252/89 |
| 4,194,986 | 3/1980 | Tournier et al. | 252/102 |
| 4,605,509 | 8/1986 | Corkill et al. | 252/131 |
| 4,612,137 | 9/1986 | Kuroda et al. | 252/174.19 |

FOREIGN PATENT DOCUMENTS

| | | | |
|---|---|---|---|
| 0949843 | 6/1974 | Canada | 252/174.19 |
| 4771796 | 3/1974 | Japan . | |

OTHER PUBLICATIONS

*Synthetic Detergents* (7th ed.), A. S. Davidsohn and B. Milwidsky; John Wiley, N.Y., (1987), p. 93.

"Builders in Liquid Laundry Detergents", Colin A. Houston, *Proceedings from the Second World Conference on Detergents*, American Oil Chemists Society, 1987, p. 163.

*Primary Examiner*—Paul Lieberman
*Assistant Examiner*—A. Beadles-Hay
*Attorney, Agent, or Firm*—Jerome L. Jeffers

[57] ABSTRACT

Disclosed is a fabric cleaning process which involves contacting the fabric with a cleaning solution comprising an anionic detergent and sodium citrate as detergent builder at a temperature above about 70° C.

5 Claims, No Drawings

METHOD OF HIGH TEMPERATURE LAUNDERING USING SODIUM CITRATE AND AN ANIONIC

BACKGROUND OF THE INVENTION

Since the early 1970's, when concern over the environment caused many areas of the United States to restrict or eliminate the use of phosphates in heavy duty laundry detergents, the industry has been turning to other sources for the control of water hardness ions in wash water, i.e. calcium and magnesium. More recently, the desire to replace phosphate detergent builders with environmentally safe substitutes has become apparent in other parts of the world.

With the advent of liquid heavy duty detergents, sodium citrate, the trisodium salt of citric acid, has become the builder of choice. Sodium citrate is suitable for use as a builder in heavy duty laundry detergents because of its ability to sequester positively charged calcium and magnesium ions found in tap water and, unlike phosphate builders, it is environmentally safe. It is especially suitable for inclusion in liquid detergent formulations because, unlike other environmentally safe detergent builders, trisodium citrate is soluble therein.

Sodium citrate containing, liquid detergent formulations have enjoyed considerable success in the United States where normal washing temperatures range from about 20° to 50° C. Such formulations have not been successfully introduced in regions such as Western Europe, where normal washing temperatures typically range from 60° to 90° C., because of the widely held belief that sodium citrate is not an effective detergent builder at these elevated temperatures. This is reported in *Synthetic Detergent,* 7th Edition, p. 93, A. S. Davidsohn & B. Milwidsky; John Wiley, New York (1987) and "Builders in Liquid Laundry Detergents", Colin A. Houston, *Proceedings from the Second World Conference on Detergents,* American Oil Chemists Society, 1987.

SUMMARY OF THE INVENTION

The present invention involves a method of cleaning soiled fabrics which involves contacting them with an aqueous composition comprising hard water, an anionic detergent and sodium citrate. The sodium citrate is present in an effective amount for detergent building purposes, i.e. from about 2 to 18 weight percent of the non-aqueous phase of the composition and the fabric is contacted with the aqueous composition at a temperature of from about 70° C. up to its boiling point.

DESCRIPTION OF THE INVENTION

The present invention is predicated on the discovery that sodium citrate is an effective detergent builder for use in conjunction with anionic detergents at temperatures above about 70° C. While the experiments that led to this discovery tend to confirm the conventional wisdom that its efficacy as a detergent builder diminishes as the temperature of the wash water approaches 60° C., it has unexpectedly been discovered that this decrease in activity can be reversed by increasing the wash water's temperature to a level of above about 70° C. It has been further discovered that, at higher concentrations of sodium citrate (e.g. about 15%), there is no diminution of its building efficacy even in the 60° to 70° C. temperature range.

Accordingly, pursuant to this discovery, sodium citrate can be used as the sole builder in anionic detergent formulations intended for use in high temperature cleaning. A typical formulation will contain, on a weight/weight basis, from about 10 to 30% of an anionic detergent, e.g. an alkylaromaticsulfonate or an alkylethoxylate sulfate; from 0 to 20% of a non-ionic detergent, e.g. an alcohol ethoxylate; 2 to 18% preferably about 5 to about 10% sodium citrate together with minor amounts of other ingredients such as fluorescent whitening agents, anti-redeposition agents, enzymes, dyes and perfume.

The present invention is further illustrated by the following examples wherein the following anionic detergent formulation was used:

30% w/w Stepan Bio Soft D-62 from Stepan Company, Northfield, Ill.—Sodium linear alkylate sulfonate—60% active in slurry form.
12% w/w Sodium Xylene Sulfonate
5% w/w Sodium Sulfate
pH adjusted to 9.0 with triethanolamine q.s. to 100 parts with deionized water.

Two soil types and two fabric types were used:
Ground-in-clay on cotton.
Ground-in-clay on cotton/polyester.
Dust-sebum on cotton.
Dust-sebum on cotton/polyester.

These were in the form of pre-soiled swatches from Scientific Services, Oakland, N.J. Three cloths of each type were put into Terg-o-tometer pots for a total of 12 cloths in each pot. The percent soil removed was calculated using reflectance values obtained from a Hunter D-25 optical sensor using the following equation:

$$\% \text{ Soil Removal} = \frac{R_s - R_w}{R_s - R_o} \times 100$$

where:
$R_s$=soil reflectance (unwashed cloth)
$R_w$=washed soil reflectance
$R_o$=unsoiled reflectance The increase in detergency due to the builder was calculated as:

$$\frac{\text{\% Soil Removed w/Builder} - \text{\% Soil Removed w/o Builder}}{\text{\% Soil Removed w/o Builder}} \times 100$$

Sodium citrate at 5, 10 and 15% (w/w) was used as the builder. It was added to the Terg-o-tometer pot rather than being formulated into the detergent. A total of 12 replications of each cloth were run during this study; a statistical confidence level of 90–95% was calculated for this data using the Student's T Distribution test. These tests were carried out at water temperatures of 40°, 50°, 60°, 70°, 80° and 90° C.

Using the data generated during these tests in the above formula provides the following improvements, in terms of increase in detergency, for the detergent-/sodium citrate formulation:

| | 40° | 50° | 60° | 70° | 80° | 90° |
|---|---|---|---|---|---|---|
| 5% Sodium Citrate/% Improvement Over Detergent Alone | | | | | | |
| Ground-in-clay/cotton | 12 | 23 | 6 | 7 | 16 | 9 |
| Ground-in-clay/cotton polyester | 13 | 20 | 9 | 7 | 25 | 44 |
| Dust-sebum/cotton | 17 | 24 | 14 | 0 | 23 | 13 |
| Dust-sebum/cotton polyester | 16 | 15 | 0 | 14 | 28 | 8 |
| 10% Sodium Citrate/% Improvement Over Detergent Alone | | | | | | |
| Ground-in-clay/cotton | 12 | 31 | 21 | 9 | 15 | 39 |

-continued

| | 40° | 50° | 60° | 70° | 80° | 90° |
|---|---|---|---|---|---|---|
| Ground-in-clay/cotton polyester | 16 | 30 | 12 | 8 | 29 | 15 |
| Dust-sebum/cotton | 31 | 51 | 24 | 18 | 29 | 48 |
| Dust-sebum/cotton polyester | 29 | 29 | 7 | 16 | 31 | 87 |
| 15% Sodium Citrate/% Improvement Over Detergent Alone | | | | | | |
| Ground-in-clay/cotton | 19 | 28 | 29 | 37 | 39 | 29 |
| Ground-in-clay/cotton polyester | 9 | 18 | 13 | 20 | 15 | 30 |
| Dust-sebum/cotton | 35 | 39 | 47 | 44 | 48 | 39 |
| Dust-sebum/cotton polyester | 65 | 65 | 60 | 67 | 87 | 39 |

From the above data it can be determined that, at the 5% level, the apparent detergency building power of sodium citrate decreases in the temperature range of approximately 60°–70° C., as one would expect based on the teachings of the prior art. However, it was discovered that this apparent decrease in efficacy is reversed as the temperature is increased to above about 70° C., so that it becomes equal to or greater than that observed at lower temperatures with certain soil/fabric combinations. With 10% sodium citrate, the decrease in detergent building efficacy begins to decrease at 60° with a further decrease being observed at 70° . However, further temperature increases reverse this trend to bring the building power of the sodium citrate back up to and, in some cases, above the level at which it was at lower temperatures. A decrease in building efficacy with a 15% loading of sodium citrate is not apparent at any temperature. Apparently, at this concentration, the forces that tend to decrease builder efficacy with increasing temperature are overwhelmed by the highly concentrated sodium citrate.

What is claimed is:

1. A method of cleaning soiled fabric which involves contacting it with an aqueous composition consisting essentially of hard water, from about 10 to 30% of an anionic detergent, 0 to 20% of a non-ionic detergent and 2 to 18% sodium citrate as the sole detergent builder at a temperature in the range of from about 70° C. to the boiling temperature of the composition.

2. The method of claim 1 wherein the composition contains at least about 5% weight sodium citrate based on the non-aqueous phase of the composition.

3. The method of claim 2 wherein the composition contains from about 5 to about 10% sodium citrate.

4. A method of cleaning soiled fabric which involves adding a formulation consisting essentially of about 10 to 30% of an anionic detergent, and about 2 to 18% sodium citrate as the sole detergent builder to hard water to form an aqueous detergent composition and contacting this composition with the soiled fabric at a temperature in the range of from about 70° C. to the boiling temperature of the formulation.

5. The method of claim 4 wherein the formulation contains from about 5 to about 10% sodium citrate.

* * * * *